US006674071B2

(12) United States Patent
Franzen et al.

(10) Patent No.: US 6,674,071 B2
(45) Date of Patent: Jan. 6, 2004

(54) ION-GUIDE SYSTEMS

(75) Inventors: Jochen Franzen, Bremen (DE); Andreas Brekenfeld, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 4 days.

(21) Appl. No.: 10/313,924

(22) Filed: Dec. 6, 2002

(65) Prior Publication Data

US 2003/0136905 A1 Jul. 24, 2003

(30) Foreign Application Priority Data

| | | |
|---|---|---|
| Dec. 6, 2001 | (DE) | 101 59 923 |
| Dec. 18, 2001 | (DE) | 101 62 265 |
| May 15, 2002 | (DE) | 102 21 468 |

(51) Int. Cl.[7] ..... H01J 49/42
(52) U.S. Cl. ..... 250/292
(58) Field of Search ..... 250/292, 396 R

(56) References Cited

U.S. PATENT DOCUMENTS 6,107,628 A * 8/2000 Smith et al. ..... 250/242

* cited by examiner

*Primary Examiner*—Kiet T. Nguyen

(57) ABSTRACT

The invention relates to ion-guide systems for the transfer, cooling, fragmentation, selection and temporary storage of ions. The invention consists in embedding systems, made from one or more straight or curved rods to which a single or multiphase radio frequency voltage is applied, in an external enveloping dc potential. The combination of the ion-repelling radio-frequency pseudo field around the rods and the external dc voltage field represents a new category of ion-guide systems. With external dc voltage fields, whose strength or penetration into the interior of the rod system varies along the axis of the system, the ions can be collected or propelled along the axis of the system. Filling the system with collision or damping gas allows the ions to be fragmented and cooled without any losses and the phase space volumes of the ions to be greatly reduced.

32 Claims, 5 Drawing Sheets

FIGURE 9A
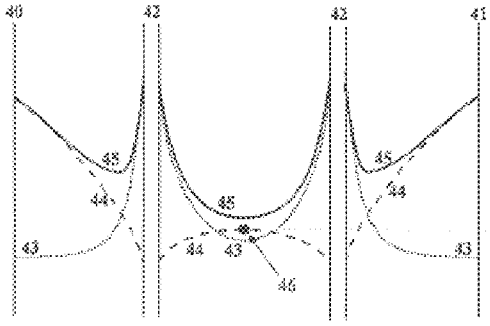
FIGURE 9B
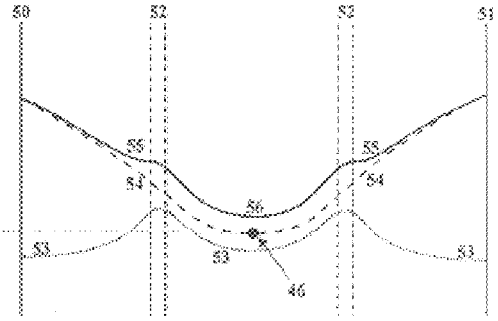
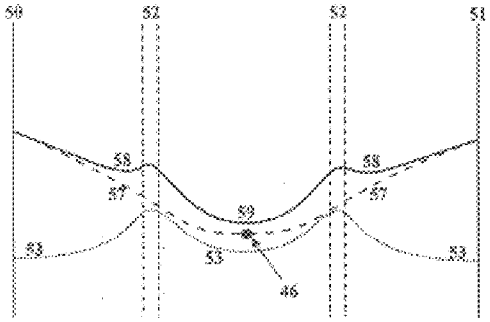
FIGURE 9C
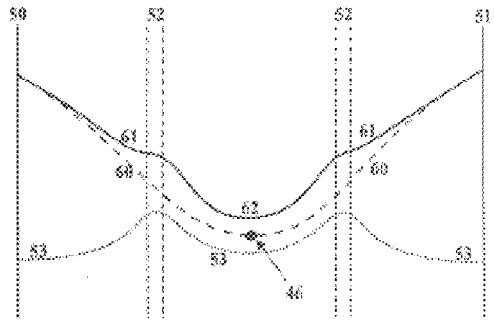
FIGURE 9D
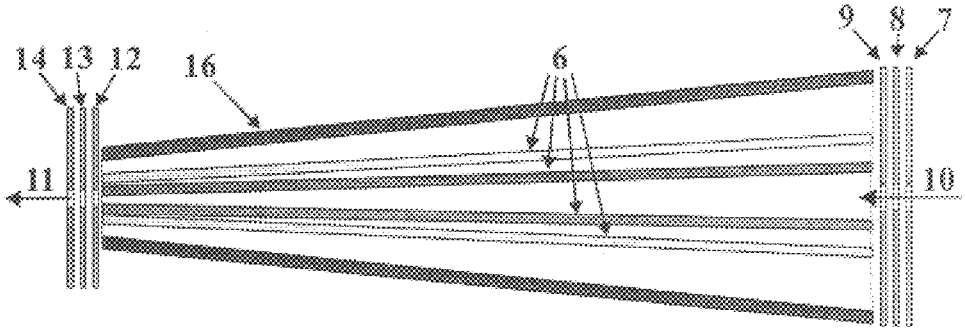
FIGURE 10

ION-GUIDE SYSTEMS

FIELD OF THE INVENTION

The invention relates to ion-guide systems for the transfer, cooling, fragmentation, selection and temporary storage of ions.

BACKGROUND OF THE INVENTION

In mass spectrometers with out-of-vacuum ion generation, it is necessary first to inject the ions into the vacuum system through apertures or capillaries and then to transmit them via various differential pump stages to the actual mass separation system, the mass spectrometric ion analyzer.

Ion transmission has long been achieved using so-called ion guides, which are generally in the form of radio-frequency carrying multi-pole systems such as quadrupole, hexapole or octopole systems consisting of long, thin parallel pole rods. Other systems are also known, e.g. the radio-frequency double helix. By using terminating diaphragms at both ends maintained at an ion-repulsion dc potential, all these systems can also be used as temporary storage devices so that, for example, ions can be injected into a pulsed mass analyzer at the correct times. Pulsed mass spectrometers in this sense include ion-trap mass spectrometers, ion-cyclotron resonance spectrometers and time-of-flight mass spectrometers with orthogonal ion injection.

The ion-guide systems consist of a number of pairs of rods (or pairs of helixes). The two phases of a two-phase radio-frequency voltage supply are applied to two neighboring rods in each case. Barriers of a so-called pseudo-potential are formed between the rods. These barriers hold the ions within the rod system. However, the pseudo-potential barriers are not very high and ions with energies greater than about ten electron volts are able to surmount them.

Radio-frequency ion-guide systems with rod-shaped electrodes have since been adopted for almost all mass spectrometers which operate with out-of-vacuum generated ions such as electrospray ionization (ESI) or atmospheric pressure chemical ionization (APCI). These types of ionization are preferably linked to a device which temporally separates the analyte mixtures by liquid chromatography or capillary electrophoresis. However, ion-guide systems can also be used for ions which have been generated in the vacuum system itself. For example, these types of ion-guide systems are used for ions which are produced by matrix-assisted laser desorption and ionization (MALDI) when they are destined for an ion-trap mass spectrometer (ITMS) or an ion-cyclotron resonance spectrometer (ICRMS or Fourier-transform mass spectrometer FTMS).

In U.S. Pat. No. 5,179,278 (D. J. Douglas), a device and method are described for supplying externally generated ions to an ion trap. In this case, the ions can be temporarily stored and freed of unwanted ions beforehand. The feed system used is an ion-guide system in the form of a multipole, i.e. a quadrupole, hexapole, octopole or higher multipole, with rod-shaped electrodes arranged in parallel to produce a two-dimensional radio-frequency multipole field. According to the claims in the patent, the multipole field is used both for the temporary storage of ions during the time the ions are analyzed in the ion trap and for preselection. Preselection is achieved by resonance ejection of the unwanted ions from the multipole system by the special application of an additional ac voltage to two opposite electrode rods or rod pairs. This method enables unwanted ion species to be removed individually by choosing the frequency of the supplementary ac voltage.

Out-of-vacuum ion generation means that the ions have to be introduced into the vacuum system. Here, a combination of injection capillaries, an initial differential pump stage, a skimmer, a second differential pump stage and a multipole system to capture the divergent, dispersing ions behind the skimmer has proved to be successful, even though by no means all of the ions introduced into the vacuum can be captured with this system. A higher-order multipole system (with a larger number of rods) is the preferred system for capturing a high proportion of the ions emerging from the skimmer at a wide angle. At the very least, a hexapole system or, better still, an octopole system is used for this purpose. With divergent ion bundles, these multipole systems are more efficient for ion capture than quadrupole systems because the reflection at the gridded wall system is better. However, many ions are lost even before the skimmer.

In the first ion-guide system after the skimmer, there is still significant residual pressure of the order of $10^{-1}$ to 100 Pascals which causes the kinetic energy of ions moving both in the direction of and across the axis to fall very rapidly. The ions tend to collect at the axis of the ion-guide system. With the special addition of a damping gas such as helium to the first or following ion guide systems, the ion beam can also be conditioned by cooling.

In this context, conditioning of the ion beam means decelerating the movement of ions and collecting them in the potential minimum of the pseudo potential at the axis or near the axis of the ion-guide system. With suitable diaphragm systems at the end of the ion guide, the ions can then be drawn from the ion-guide system and formed into a relatively fine, almost parallel ion beam. The conditioning process results in a reduction of the six-dimensional phase space volume which describes the distribution of ions in the position and momentum space. This type of conditioning by reducing the phase space volume, cannot be achieved using ion-optical methods (a consequence of Liouville's theorem). The phase space volume can only be reduced by so-called cooling processes, e.g. gas cooling or laser cooling. An ion-guide system which conditions the ions by gas cooling for injection into a mass-selecting quadrupole filter was described in U.S. Pat. No. 4,963,736 (D. J. Douglas and J. B. French).

However, the ion-guide systems are not only used for transmitting ions to the mass analyzer. When filled with gas, they can also be used for collisionally induced fragmentation. In this case, ions are injected with higher energies into an ion guide system filled with a collision gas in a certain pressure regime. The fragmentation process is referred to by the abbreviation CID (collisionally induced decomposition). Here too, whether they are fragmented or not, the ions are cooled in the collision gas. The fragmentation process in this ion-guide system (including the frequently used quadrupole system) is the more effective the greater the molecular weight of the collision gas; however, the heavier gases cannot be used since, on collision, the gas molecules frequently deflect the ions sideways so that they are then able to overcome th pseudo-potential barriers between the rods and get lost from the ion guide.

Another arrangement for the time-of-flight mass spectrometers with orthogonal ion injection is disclosed in U.S. Pat. No. 6,011,259 (Whitehouse, Dresch and Andrien) where multipole systems in the form of multipole ion guides are used both for transmitting the ions from out-of-vacuum ion sources to the mass spectrometer and for selecting and fragmenting suitable parent ions. In this case, the gas (usually nitrogen) penetrating into the vacuum system from the external electrospray source at the same time is used as a collision gas for fragmenting the ions and for damping some of the ion movement. Here, the forward movement of the ions must not be damped completely because the multipole rod systems which are used as the ion-guide systems do not provide any active means of forward motion for the ions. The velocity therefore must not be fully damped because otherwise the ions will only be able to leave the ion system by slow diffusion processes. Although these systems can be used to store the ions so that their emptying can be time-controlled according to demand, the ions generated earlier mix with the ions generated later and this interferes with the high temporal resolution of substances separated by rapid chromatography or electrophoresis. On the other hand, ions which have not been decelerated to zero velocity in the gas always have relatively large phase space volumes and are not ideally conditioned for the mass spectrometry which follows.

Similar problems are known for the so-called triple quadrupole mass spectrometers (triple-quad systems) where the central quadrupole system is filled with gas and is used for collisionally induced fragmentation. Also in this case, because of the lack of forward movement, the ions must not be decelerated to zero velocity in the middle stage because otherwise they will only be able to escape by extremely slow diffusion processes.

These radio-frequency multipole ion-guide systems consist of at least two pairs of straight pole rods which are uniformly distributed on the surface of an imaginary cylinder. The rods are supplied with the two phases of a high frequency voltage alternately. If there are two pairs of rods, a quadrupole field is set up inside the rod system; with more than two pairs of rods, a hexapole, octopole, decapole or dodecapole field etc. is produced accordingly. An ion-guide field cannot be produced with just a single pair of straight rods producing a dipolar field, although this is possible with a pair of helical rods. The fields which are produced by pairs of straight rods are frequently (but not very accurately) referred to as two dimensional since this rod arrangement produces the same field distribution at every cross section. In other words, the field distribution only changes in two dimensions and is constant in the third.

The rod systems used to transmit the ions are generally very slender so that the ions are concentrated in an area of very small diameter. They can then be advantageously operated with low radio frequency voltages (a few hundred volts at several MHz frequency) and form a relatively good starting point for further ion-optical imaging of the ions. The cylindrical inner space is often only approximately 3–4 mm in diameter and the rods are usually less than 1 mm thick. The rods are usually fitted into grooves (bonded or soldered), which are located inside the inner aperture of ceramic or plastic rings or are screwed to these rings with spot-welded tabs. The requirement for the inner diameter, i.e. the distances between the rods, to be uniform is relatively strict since non-uniformities in the cross section impede the axial movement of the ions considerably. These systems are therefore not easy to manufacture and are very sensitive to vibration and impacts because they are not very robust. The fragile rod systems are very easily bent out of alignment and cannot be re-adjusted.

If the ion-guide systems are used as ion storage systems in a relatively good vacuum, the ions which are injected into the system at low energy are reflected by the repulsion voltage of the potential diaphragm at the output end and propelled back to the input diaphragm, where they are reflected again at the other end. In this way, they travel back and forth inside the ion-guide system until they are withdrawn by the penetration of a suction field switched on at the output end or until they more or less come to a standstill due to collisions with the residual gas. They are therefore momentarily not available for any kind of use whatever; rather, emptying the ion guide system from ions takes at least as long as it takes for the ions to travel the route twice in the ion-guide system. If the ion-guide system is filled with collision or damping gas in order to damp the movement of ions, removal in a short time becomes even more problematic.

For this reason, for a long time there has been a search for ion-guide systems which allow the ions to be propelled along the axis inside the system. Several methods are presented in U.S. Pat. No. 5,847,386 (B. A. Thomson and C. L. Jolliffe) for which patent claims have been made:

- An ion-guide system consisting of a multitude of short rod systems which are axially aligned and where the axis potentials decrease in steps from rod system to rod system;
- A rod system consisting of conically tapered rods running parallel to the axis;
- A rod system consisting of rods of constant diameters but conically arranged around the axis;
- A rod system consisting of rods made from insulating material with an external resistance coating across which a dc voltage drop is produced in additional to the rf voltage;
- A rod system with auxiliary electrodes with a weak dc voltage potential between the rods where the auxiliary electrodes are arranged conically in relation to the axis of the system. In each case, the auxiliary electrodes are located at the site of zero potential of the two-phase radio-frequency voltage which alternates between the rods. An axial potential is produced which decreases along the axis.

However, these arrangements are not particularly satisfactory: some are complicated to make, and are therefore not particularly cost effective, while the operation of others is only moderately satisfactory, e.g., the transitions between the separate guide systems result in transmission losses and reflections which can only be partially overcome by using aperture diaphragms connected between. The system with the long auxiliary electrodes between the rods can only be made to operate moderately well in a quadrupole system. Even there, in practice, a large proportion of the ions are lost by touching the auxiliary electrodes which generally reduce the pseudo-potential barriers between the rods. This system is not at all suitable for fragmenting ions since the fragmentation process always scatters the ions in lateral direction so that the losses are far too high. The conical instead of cylindrically shaped ion-guide system almost only moves those ions forward which have not assembled and come to rest in the axis. The same is true for rod systems consisting of tapered rods.

But the propulsion of ions can also be imposed in an ion-guide system by using another method such as transporting the ions by a stream of collision gas. However, it is difficult to produce a sufficiently large flow of gas, which requires high pump performance from the vacuum pumps connected to the system.

Different types of ion-guide systems are disclosed in U.S. Pat. No. 5,572,035 (Franzen) which are quite different from the multipole rod systems described here. One of these consists of only two screw-shaped helical guides in the form of a double helix which are activated by connecting two phases of a radio-frequency voltage. Another system consists of a set of coaxial rings to which the phases of a radio-frequency ac voltage are alternately connected. These systems can also be operated so as to cause the ions to travel along the axis. The double helix can be made from resistance wire which produces a dc voltage drop along its length. The voltage to the individual rings in the ring system can be supplied with a continuously falling dc potential along the path. However, these systems are also not easy and cost-effective to make, since the combination of dc voltages and radio-frequency voltages is always complicated.

But ion-guide systems are not only used for the transmission of ions but also for producing an optimum ion beam as described above. Conditioning ions to form a high quality ion beam is necessary, especially in the case of time-of-flight mass spectrometers with orthogonal ion injection, since the mass resolution of these types of time-of-flight mass spectrometers crucially depends on the spatial and velocity distribution of the ions of the primary beam in the pulser.

Time-of-flight mass spectrometers with orthogonal primary ion-beam injection have a so-called pulser at the start of the flight path which accelerates a section of the primary ion beam, i.e., a thread-shaped ion packet, at right angles to the direction of the beam. This produces a ribbon-shaped secondary ion beam where light ions travel fast and heavy ions travel slowly. The flight direction of the secondary ion beam lies between the direction of the primary ion beam and the direction of acceleration at right angles to it. This type of time-of-flight mass spectrometer is preferably operated with a velocity focussing reflector which reflects the ribbon-shaped secondary ion beam in its entirety and guides it to a detector which is widened to match the beam.

If all the ions fly precisely one behind the other along a single axis and if the ions have no velocity components across the primary beam, then it is easy to see that it is theoretically possible to achieve an infinitely high mass resolution because all the ions of the same mass will be flying precisely on the same front and will reach the detector at precisely the same time. If the primary beam has a finite cross section but none of the ions have a velocity component transverse to the direction of the beam then, due to the spatial focussing behavior of the pulser, it is again theoretically possible to achieve an infinitely high mass resolution (C. Wiley and I. H. McLaren, "Time-of-flight Mass Spectrometer with Improved Resolution", Rev. Scient. Instr. 26, 1150, 1955). Indeed, a high mass resolution can still be achieved even if there is a strict correlation between the ion location (measured from the axis of the primary beam in the direction of acceleration) and the transverse velocity of the ions in the primary beam in the direction of acceleration. However, if there is no such correlation, i.e., if the ion locations and transverse velocities are distributed statistically without a correlation between the two distributions, then a high mass resolution cannot be achieved.

It is therefore necessary to condition the primary ion beam in relation to its spatial and velocity distribution in order to achieve a high mass resolution in the time-of-flight mass spectrometer.

The six-dimensional space made up of the location and impulse (momentum) coordinates is called the "phase space". In an ion beam, the location and impulse coordinates of all the ions fill a certain part of the phase space; this part is called the "phase space volume". Conditioning the primary beam therefore always involves a reduction in the phase space volume, at least in the coordinates transverse to the direction of the beam. According to the laws of physics, a reduction in the phase space volume cannot be achieved by ion-optical means but only by cooling the ion plasma of the ion beam, for example, by cooling the plasma by a damping or collision gas. Using a damping gas to cool the ions (at a cost in time) is, for example, the usual method which is used in radio-frequency quadrupole ion traps and provides a satisfactory mass resolution.

Time-of-flight mass spectrometers with orthogonal primary ion-beam injection are used in preference for the scanning of highly resolved mass spectra with fast spectral sequencing in order to track the fast substance separation in rapid separation methods, such as capillary electrophoresis or micro-column chromatography, without time smearing. As well as high mass resolution, it is also desirable for the substance ions introduced one after the other to have a high time resolution. The ions should therefore be cooled in a continuous process in such a way that there is no mixing of earlier and later ions.

Beam conditioning is necessary or at least beneficial for other types of mass spectrometer as well. Every mass spectrometer has a phase-space acceptance cross section which determines which of the injected ions are accepted and which of the injected ions are deflected away or reflected.

SUMMARY OF THE INVENTION

The invention consists of embedding elongated ion guides composed of one or more straight, curved or helical rods, which are supplied with single or multiphase radio-frequency voltages, in an external non-zero enveloping dc potential. The dc potential is defined as the potential difference with reference to the mid potential of radio-frequency ac voltage of the rod system. In the following, the inner system, which is made up of rods shaped according to the state of the art, will simply be referred to as the "rod system" in contrast to the term "ion-guide system" which, in this context, also includes the external envelope electrodes needed to set up the enveloping dc potential. The term "ion-guide system" therefore does not refer to the conventional radio-frequency ion-guide systems containing rod systems which are connected to radio-frequencies but which are operated without external enveloping dc voltage and without external enveloping electrodes. The term "elongated" will merely refer to the fact that the distance along the rods in the rod system from end to end is longer than the largest diameter of the cross section of their arrangement. "Embedding" in a dc potential (or "enveloping" with a dc potential) in this context means that the external electrodes are used to create an equipotential surface to surround the rod system even when the enveloping electrodes do not form a closed surface, as in the case of a net or grid.

The combination of a continuously ion-reflecting, radio-frequency pseudo-potential on the rod or rods and an external embedding dc potential results in a new category of ion-guide systems with a series of unexpected properties.

Such a novel ion-guide system is produced, for example, when a rod system, made up of largely parallel rods carrying a single, or multiphase, radio-frequency voltage, is surrounded by an external electrode in the shape of a hollow cylinder connected to an ion-repelling dc voltage. The dc voltage produces an essentially radial electric field between the external electrode on the one hand and the internal rod system on the other. With systems consisting of several rods, the field penetrates through the spaces between the rods or wires and produces a combined field of the penetrating dc voltage field and the continuously repelling pseudo-field of the rods inside the rod system.

The strength of an ac field around a single long wire or rod carrying a radio-frequency decreases outwardly at the rate of 1/r and, within this highly inhomogeneous alternating field, reflects both positively and negatively charged particles above a certain threshold of mass-to-charge ratio. The reason for this is that particles which are sufficiently heavy oscillate in the ac field. The particles, irrespective of their charge, experience the highest acceleration away from the wire exactly when they are at the point in their oscillation nearest to the wire, i.e., at the point of highest field strength, and the highest acceleration toward the wire when it is at the furthest point from the wire, i.e., at the point of lowest field strength. Thus, integrated over time, the particles experience a strong repulsion away from the wire. The repulsion acquired by temporal integration can be described (with reference to the works of Nobel-prize winner Hans Dehmelt) by a "pseudo dc voltage potential" or simply a "pseudo-potential" which is proportional to the square of the ac field strength. Therefore, for a long wire, the repelling pseudo-potential decreases outwards at the rate of $1/r^2$, where r is the radius. Furthermore, the pseudo-potential is inversely proportional to the mass m of the ion and proportional to the radio-frequency voltage V and the square of the frequency. The threshold for light particles is determined by ability of the lightweight particles either to reach the rod or to escape the reach of the field altogether within a half period of the radio-frequency voltage with the extra energy acquired.

Consequently, each rod independently has a repelling pseudo-potential for sufficiently heavy particles. Between two rods, if the phases of the two ac voltages are different for the different wires, a repelling pseudo-potential with a potential barrier is set up which sags from rod to rod and drops at both sides; it thus forms a saddle. Conventional multipole systems require this saddle-like potential barrier between each pair of neighboring multipole rods in order to keep the ions inside the rod system. However, this is not necessary for the ion-guide systems according to the invention.

In comparison to conventional, multipole ion-guide systems, it is therefore surprising to be able to operate a system consisting of parallel rods even when a single-phase radio-frequency voltage is applied to all the rods equally. This is in sharp contrast to previous radio-frequency, multipole ion-guide systems which require a two or more phase radio-frequency voltage. Consequently, it is also possible to set up an ion-guide system with non-paired rods such as a single straight rod to carry the radio frequency and a tube to carry the ion-repulsion potential.

The simplest system according to the invention therefore consists of a central rod to carry the radio-frequency voltage inside a cylindrical tube that carries the ion-repulsion dc potential with reference to the center radio-frequency voltage on the rod. The pseudo-potential of the rod decreases outwards from the rod at $1/r^2$ while the dc voltage potential increases outwards with the logarithm ln(r). A cylindrical potential trough is formed from the combined dc voltage and pseudo-potential around the rod where the ions are able to collect. Since the pseudo potential depends on the masses of the ions, the minimum of the potential trough for heavy ions is located nearer the central rod than the minimum for light ions.

If the rod is not located at the axis of the tube but to one side of it nearer to the wall of the tube, then a potential trough is formed around the rod so that the depth of the trough is not symmetrical at all points. The deepest point is in the interior of the tube (see FIG. 2). Looking at the entire length of the tube, the potential minimum will appear as a thread running parallel to the rod inside the tube. Again, the heavier ions will be nearer the rod than the lighter ions. This form of mass separation of the ions can be utilized for a mass spectrometric analysis or ion separation.

From conventional ion-guide systems it is known that the inputs and outputs can be provided with diaphragm systems which prevent the ions from escaping and therefore keep them inside the guide system. This is also true for the ion-guide system according to the invention.

With a knowledge of this invention, it is possible to set up various ion-guide systems with helixes or rod systems consisting of parallel, straight rods carrying one or more phase radio-frequency voltages such as those described below. With a suitable choice of relative dc voltage and radio-frequency voltage strengths, these types of ion-guide systems using rod systems are unique enough to be fundamentally different from conventional multipole, ion-guide systems. It is not necessary to inject the ions into the rod system since it is sufficient to supply them to the ion-guide system anywhere, i.e. even to the space outside the rod system. When the movement energy of ions with a kinetic energy which is not too high is damped in a damping gas, the ions are automatically transferred into the interior of the rod system without any losses since they are never able to reach the envelope electrode or the rods because of the electrical repulsion.

The ion-guide systems according to this invention are particularly suitable for filling with damping gas to cool the ion movements or with collision gas to fragment the ions. The external envelope of potential-carrying electrodes makes it possible to use small quantities of gases and relatively small vacuum pumps.

One of the special features of this novel ion-guide system is that by shaping the external potential, a potential gradient can be set up for the ions which enables them to be guided actively along the length of the ion-guide system through the gas to the output at the end. This can be achieved by setting up an increasing or decreasing potential along the length of the envelope tube, for instance by using a current-carrying resistance coating along the length of the enveloping tube or by using a conical tube for the envelope potential or even by using conical rod systems in cylindrical tubes. Again, using conical rod systems produces unexpected effects which will be explained in more detail below. A coating with resistance material with voltage tappings can be connected in such a way that the direction of acceleration can be reversed or collection pockets can be formed which can be emptied at will by actively forcing the ions to move in the desired direction at the right time.

With this invention, it is possible to construct ion-guide systems which are particularly suitable for conditioning the beam by cooling the ions in a damping gas and for producing a very fine, almost monoenergetic ion beam. These novel ion-guide systems are similarly suitable for fragmenting ions without losses, even for fragmentation by collision with collision gases of high molecular weight such as those which are necessary for certain classes of substances. These systems can also be used to capture ions which are blown into the vacuum of a mass spectrometer with a jet of gas at atmospheric pressure, effectively and without losses.

BRIEF DESCRIPTION OF THE DRAWINGS

Reference numbers of instrument components throughout the figures:

| | |
|---|---|
| 1 | Single rod with single-phase radio-frequency voltage |
| 2 | Double helix inner rod system with two-phase radio-frequency voltage |
| 3,4 | Pairs of rods which can be connected individually in a quadrupole system |
| 5 | Hexapole rod system consisting of parallel rods |
| 6 | Hexapole rod system consisting of rods arranged in a cone |
| 7,8,9 | Injection diaphragms for ions in the ion-guide system |
| 10 | Direction of injection and injection beam of ions |
| 11 | Direction of emergence and emerging beam of ions |
| 12,13,14 | Output diaphragms for ions from the ion-guide system |
| 15 | Cylindrical tube as envelope electrode |
| 16 | Conical tube as envelope electrode |
| 17 | Conical grid as envelope electrode |
| 18 | Trumpet-shaped tube as envelope electrode |
| 19 | Toroidal collector with trumpet-shaped inner opening as an envelope electrode |
| 20 | Cylindrical resistance tube as envelope electrode |
| 21 | Square resistance tube as envelope electrode |
| 22,23,24,25 | Voltage tappings for connecting voltages to the resistance tube |
| 26 | Slit in envelope electrode for outpulsing ions |
| 27 | Injection capillary for mixtures of gases and ions |
| 28 | Pumping direction for injected gases |

Figure 1:
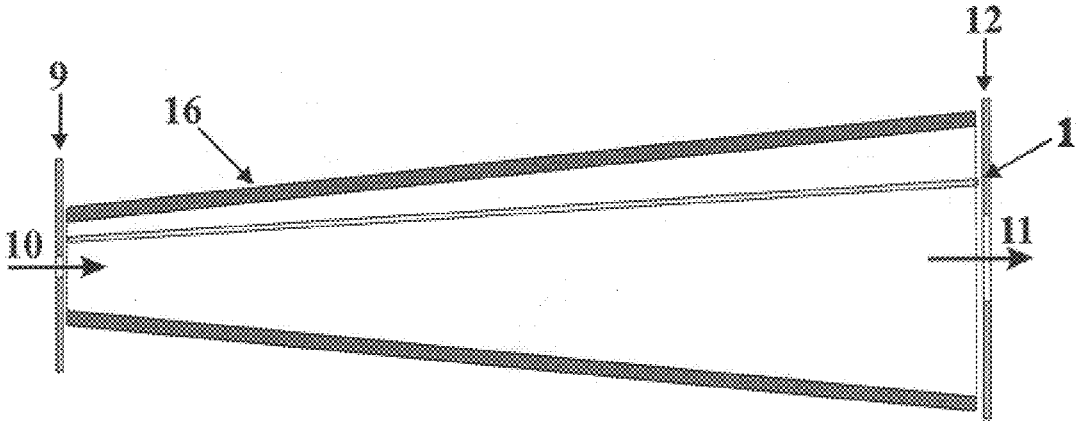

FIG. 1 shows a simple embodiment of the invention with a single radio-frequency voltage rod (1) which is located off-center inside a cone-shaped tube (16) carrying an ion repelling dc voltage potential, causing a forward propulsion of the ions.

Figure 2:
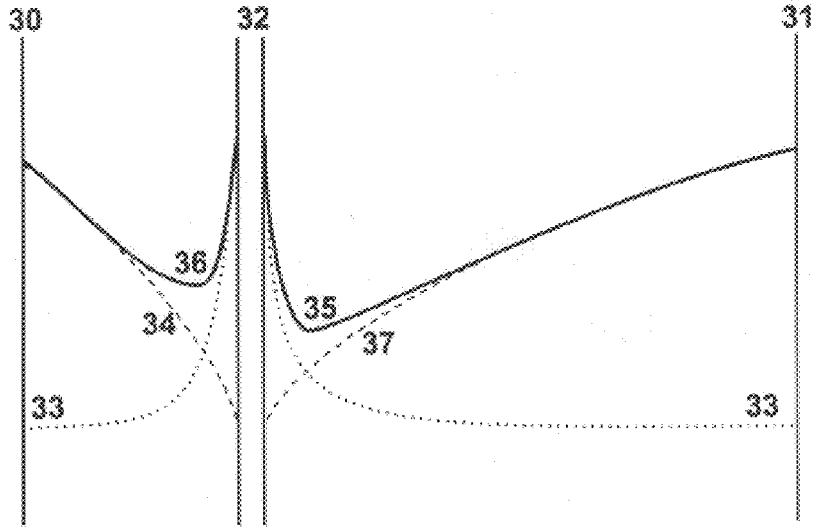

FIG. 2 shows the dc and pseudo-dc potential characteristics in a cross section of the device shown in FIG. 1.

Figure 3:
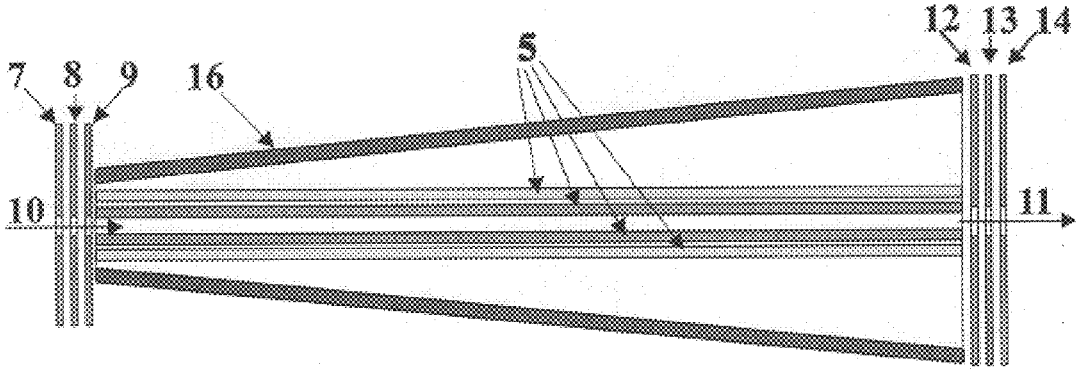

FIG. 3 shows a hexapole ion-guide system (5) with forward propulsion for ions by a conical shape of the envelope (16).

Figure 4:
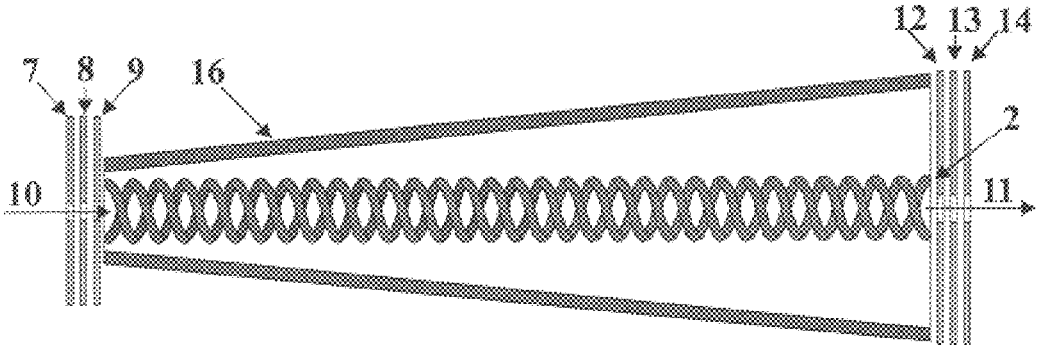

FIG. 4 show a similar ion-guide system with ion propulsion where a double helix (2) is used.

Figure 5:
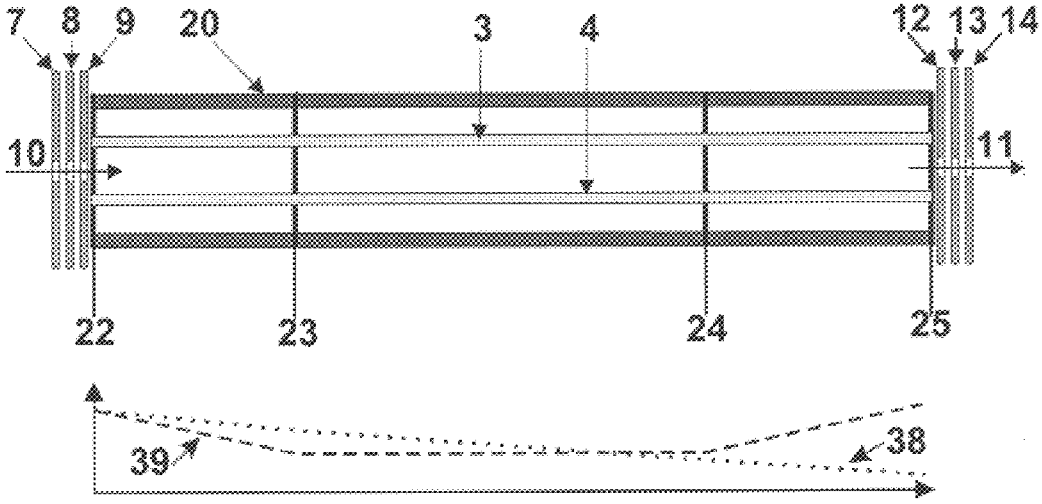

FIG. 5 shows an ion-guide system with a quadrupole rod system surrounded by a tube (20) made from resistance material with voltage tappings (22), (23), (24) and (25) for the applied voltages. The dashed potential curve (37) shown in the lower part of the figure, for example, produces a long collection space for the ions in the center of the rod system. The dotted potential curve (38) causes the ions to leave the system at the front through the diaphragm (12).

Figure 6:
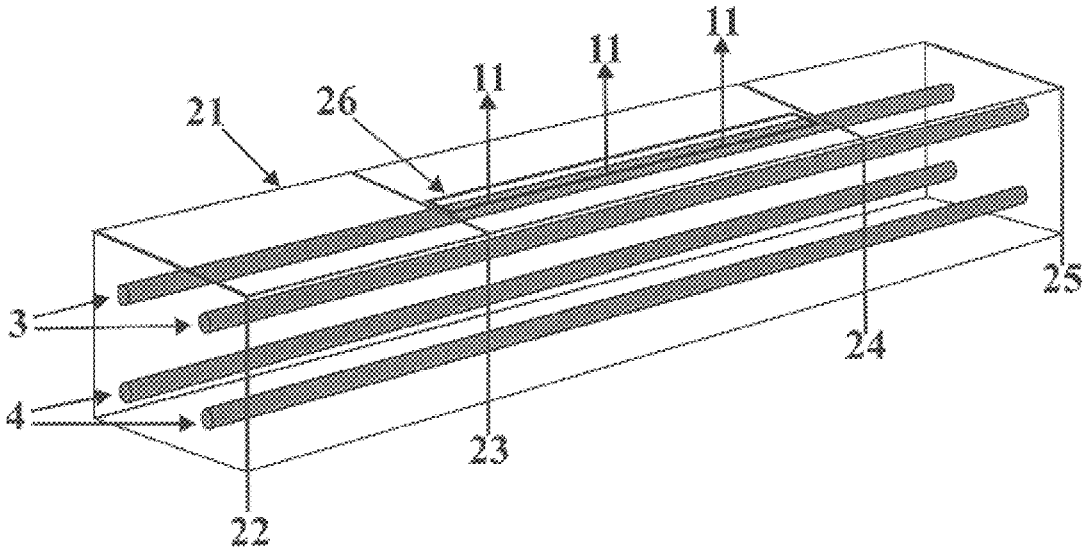

FIG. 6 shows an ion-guide system similar to the one in FIG. 5 for orthogonal ejection of cooled ions.

Figure 7:
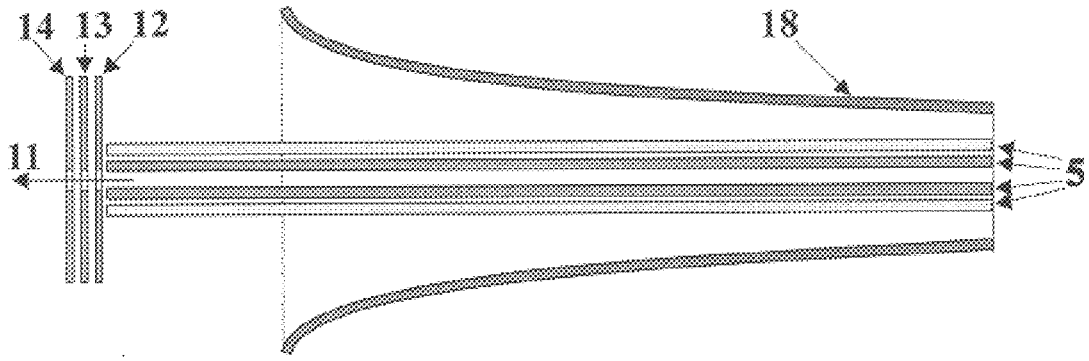

FIG. 7 shows an ion-guide system with a hexapole rod system (5) enclosed in a trumpet-shaped tube (18).

Figure 8:
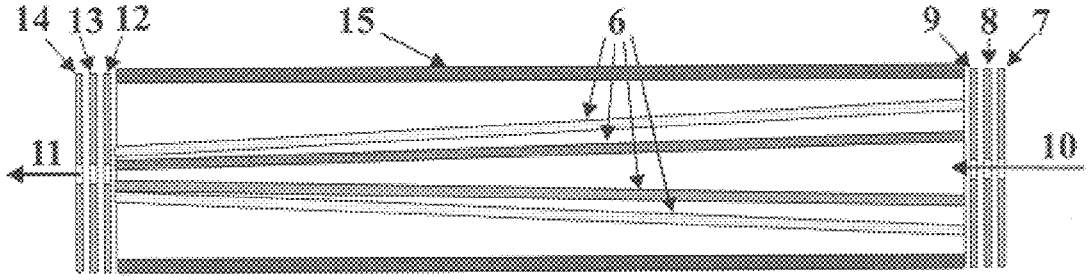

FIG. 8 shows an ion-guide system in the form of a hexapole rod system with a conical arrangement (6) of the rods inside a cylindrical tube (15).

In FIG. 9A (top left) and 9B (top right), potential curves are shown for two cross sections through an ion-guide system with a hexapole rod system: one cross section passing through the rods (42) (9A top left) and another cross section passing through the gaps between the rods (52) (9B top right).

FIGS. 9C (bottom left) and 9D (bottom right) show the same cross section as that shown in FIG. 9B (top right) but with different dc voltages.

FIG. 10 shows an ion-guide system where all ions which have escaped from inside the rod system are forced to return.

Figure 11:
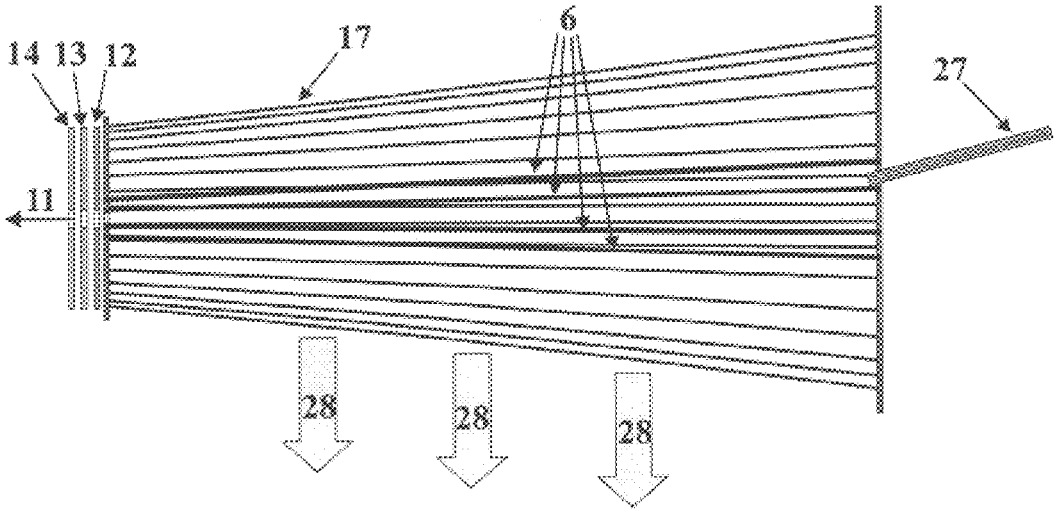

FIG. 11 shows an embodiment in which the ions are sieved out of a jet of gas, which is introduced through a capillary (27) from an ion source at atmospheric pressure.

Figure 12:
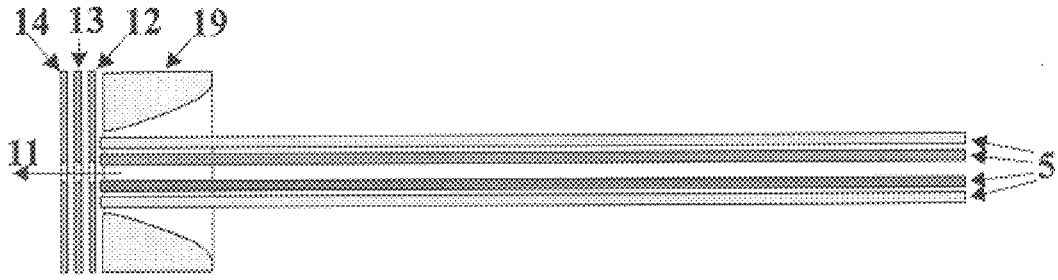

In FIG. 12, an arrangement is shown with an end-positioned collection point for the ions.

DETAILED DESCRIPTION

The simplest system according to this invention, which is, however, thoroughly practical consists of a central rod in a cylindrical tube. The rod carries a radio-frequency voltage, such as 200 volts at 5 MHz which sets up an ion-repelling pseudo-potential. The tube carries an ion-repelling dc voltage potential such as approximately 10 to 20 volts in reference to the zero voltage of the radio frequency on the rod, i.e., the voltage in the center between the two peak voltages of a sinusoidal radio-frequency voltage. The pseudo-potential and the dc voltage potential then combine to form a cylindrical potential trough in which the ions can collect. The pseudo-potential decreases outwards at $1/r^2$ while the dc voltage potential increases outwards at ln(r). Since the strength of the pseudo-potential is inversely proportional to the mass of the ions, the minimum of the potential trough is nearer to the central rod for the heavier ions than the minimum for the lighter ions. Ions which are injected into the ion-guide system with energies which are not too high cannot reach the rod because of the repelling radio-frequency, but neither can they reach the wall of the tube because of the repelling dc voltage. There are therefore no ion losses in this system, even when the system is filled with damping gas. The pressures which can be used for the damping gas in this case range from approximately 0.01 to 100 Pascal or possibly even higher.

It should be noted that an ion-guide system consisting of a tube with a single, very thin wire stretched along the axis has been known for a long time. The wire is connected to a dc potential which attracts ions and the tube is connected to a dc potential which repels ions. The injected ions follow elliptical tumbling paths (a two-dimensional Kepler movement) around the wire and maintain their velocity in the direction of the axis until they emerge again from the ion-guide system. If the angle at which they were originally injected does not happen to be directed precisely toward the wire, they will never touch the wire. This arrangement, however, is very different to that of the invention, since it only functions under very good vacuum. As soon as there are collisions which dampen the velocity, the particles soon land on the wire. Cooling is therefore not possible since the wire has no repelling effect. On the contrary, with this arrangement, the wire attracts the particles. The ions discharge on meeting the wire and are thereby destroyed.

Referring back to this invention, if the rod carrying the radio-frequency voltage is not in line with the axis of the tube but is nearer to the wall of the tube on one side, then the depth of the potential trough is not the same at all points around the rod. A system similar to this is shown in FIG. 1 (but the envelope in FIG. 1 is a conical tube and the effect of this will be described in more detail below). The distribution of the combined potential of the pseudo-potential and the dc voltage potential in a cross section through the system is shown in FIG. 2. The potential trough (36) between the rod and the nearest point on the wall of the tube is significantly higher than the potential minimum (35) between the rod and the furthest point on the wall of the tube. Looking along the length of the ion-guide system, a threadlike potential minimum therefore forms, stretched out parallel to the rod (1) inside the tube. Again, the heavier ions will be found to be nearer the rod (1) than the lighter ions, which means that it is not very easy to produce a homogeneous ion beam from ions of all masses. Without going into more detail, it should be noted here that the mass separation can also be utilized.

If the rod is wound around the axis of the tube, then ions inside the helix will collect together to form a complex path.

The helix must not be wound too tightly since the penetration of the outer potential must not be cut off. In the borderline case of a very tight helix wound to form a cylindrical potential, there is no longer any field inside the helix and the collection of ions is no longer possible.

With two straight, parallel rods in a cylindrical tube, where the ions assemble depends on the type of feeding with the radio-frequency voltage and its distance. If the same radio-frequency phase is used for the two rods, the ions will collect between the two rods if the rods are a large distance from each other. At the same time, there will be two linearly extended collection sites for ions of the same mass in each case, both of which will lie in the plane through the two rods. When using a two-phase, radio-frequency voltage, the collection sites for the ions lie outside the plane through the two rods in a central plane between them since the rod dipole sets up an ion-repelling, saddle-type pseudo-potential between the two rods which, although "sagging" from one rod to the other, prevents a potential minimum from developing between the rods (unless the external dc voltage potential is very high).

An ion-guide system according to this invention may also consist of three parallel rods carrying a single phase of a radio-frequency voltage or three rods carrying the three phases of a three-phase radio-frequency voltage.

Two double-helix type rods (similar to that in FIG. 4) are a good way to collect ions within the double helix when a two-phase radio-frequency voltage is applied.

Of particular interest is the collection and transmission of ions in a quadrupole rod system which is confined within a dc voltage potential according to the invention since, in this case, depending on the choice of radio-frequency and dc voltage, very favorable conditions can be achieved for setting up sharply defined potential troughs in the axis of the system. Here, it is beneficial for the rods to be connected to the two phases of a radio-frequency voltage alternately, although single-phase operation is possible here also. The sharply defined potential troughs are again suitable for forming very fine ion beams from well cooled ions. In this way, it is possible to achieve extremely small phase space volumes.

Particularly surprising with these multi-rod systems is the extremely small ion losses during the fragmentations when using the correct combination of dc and radio-frequency voltages. Even when fragmenting ions which have been injected into collision gases of high molecular weight, very few ions are lost.

In conventional quadrupole systems, such as those used as fragmentation quadrupoles in triple quadrupole mass spectrometers (triple quads), collision gases of high molecular weight cannot be used. For fragmentation, the ions must be injected with an energy of approximately 100 electron volts. When the ions collide with heavy collision gas molecules, the injected ions almost always experience strong lateral deflections which are strong enough for the deflected ions, whether fragmented or not, to escape over the relatively flat pseudo-potential barriers between the rods. In conventional quadrupole systems, the heights of the pseudo-potential barriers are only approximately 5 to 10 volts and depend, in particular, on which lightest fragment ions still have to be captured since the radio-frequency voltage set is oriented accordingly. The radio-frequency voltage setting has to be lowered according to how light the ions are which have to be captured; however, by reducing this voltage, the pseudo-potential barrier is also reduced.

With the ion-guide systems according to the invention, consisting of quadrupole rods surrounded by a repelling dc field, the barriers between the rods are now very much higher. With a well chosen dc voltage (similar to that in FIG. 9D) they are not barriers in the true sense since the potential increases continuously toward the wall of the tube. Ions in the outer space of the rod system are inevitably transported back to the inner space of the rod system since they can reach neither the tube nor the rods with their repulsion potentials. The only ion losses which can occur, do so at inadequately designed potential caps at the ends of the ion-guide systems due to the diaphragms (9) and (12) fitted there and their potentials.

Collision gases of high molecular weight lead to other fragmentation mechanisms which are far more beneficial for certain classes of substances. Some classes of substances such as plastic polymers can only be fragmented by heavy collision gases. Immonium ions from the fragmentation of proteins are also generated preferentially only when using heavy collision gases. The possibility of using collision gases with large molecular weights is thus a very considerable advantage of this invention.

Unlike the high-performance, quadrupole filter mass spectrometers where hyperbolic electrodes or, at least, relatively thick round electrodes are used, it is more beneficial to use thin rods to which a correspondingly $1/r^2$ higher radio-frequency voltage is applied (four times the voltage at half the radius) for the ion-guide system of this invention. The losses of ions with somewhat higher input energies due to touching the rods are therefore lower. For example, radio-frequency voltages of approximately 800 volts at 6 MHz carried by rods of approximately 0.8 mm diameter are advantageous. Under these circumstances, it is not possible at ail for ions with moderate injection energies (for example, up to 50 or 100 electron volts) to reach these rods (when their mass-to-charge ratio is above the threshold value). If the diameter of the tube is also relatively large, then a relatively high voltage, such as 200 volts, can be applied to the envelope electrode and this makes it impossible for the ions to reach the wall of the tube. Ions below a relatively high kinetic-energy barrier are therefore inevitably captured without losses. The situation is quite different for conventional radio-frequency multipole ion-guide systems. Due to the damping process, the ions then collect inside the quadrupole system, even if they have escaped into the outer space in the meantime.

The conventional ion-guide systems, which are usually in the form of hexapole or octopole systems, can also be beneficially embedded in outer dc-voltage potentials according to this invention. This provides them with completely new properties. Here too, the potential barriers between the rods are higher so that lower radio-frequency voltages can be used and this again leads to the stable capture and transmission of lighter ions. In this case, also ions can be returned from the outer space to the inner space of the rod system if the ion-guide system is skillfully designed.

Every conventional multipole system without a surrounding dc field has a lower mass threshold for the stable retention of ions within the rod system (or more correctly—a threshold for the mass-to-charge ratio). Ions below this threshold are propelled out of the system. This lower mass threshold is lowered in the system according to the invention.

Another advantage of enveloping the multipole systems in an outer potential is the formation of a sharper potential minimum inside. This has the effect of improving the reduction in phase space volume by cooling the ions in the damping gas.

The collection of ions does not necessarily take place at the axis of the system. Depending on the choice of ratio between the radio-frequency voltage and the dc voltage, collection can be forced to take place at the axis or in threadlike potential troughs along the length of the rods.

Also with these with hexapole or octopole rod systems in ion-guide systems according to the invention, the ions can be confined inside without any risk of escape or losses when they do not have sufficient energy to reach the envelope electrode or the rods carrying the radio-frequency. As usual, the ends must be blocked by diaphragms (9) and (12) so that the ions cannot escape here either and the dc voltage must be high enough to prevent secondary minima forming outside the rod system (see FIGS. 9A to 9D). The only exit is then the apertured diaphragm (12) at the output end.

One of the most interesting aspects of this invention, however, is that by embedding the rod system in a skilfully shaped outer dc voltage potential, it is possible to produce potential gradients along the axis which can be used to propel and gently push the ions in the direction of the axis.

A potential gradient such as this along the axis of the ion-guide system can be produced by decreasing the outer dc voltage potential along the axis of the envelope tube (FIGS. 5 and 6) or by changing distances along the axis between the outer electrode for the dc voltage potential and the rod system carrying the radio-frequency, for example, by using conical, trumpet-shaped or bell-shaped envelope electrodes (FIGS. 1, 3, 4, 7, 10 and 11). Finally, with multipole systems, the penetration can be increased or decreased along the axis into the interior of the rod systems by using rods with a conical shape or rods in a conical arrangement (FIGS. 8, 10 and 11).

A very simple case of forward ion transport in an ion-guide system according to this invention is shown in FIG. 1. FIG. 1 shows a very simple embodiment of the invention with a radio-frequency voltage rod (1) which is located off-center inside a cone-shaped tube (16) carrying an ion repelling dc voltage potential which not only repels the ions from the wall but also propels the collected ions forwards. The ions which are injected through the diaphragm (9) in direction (10) collect in the center of the conical tube (16) after being cooled by the damping gas which has been introduced into the system and are then propelled in the direction of the outlet (11) by the weak potential gradient produced by the conical shape of the outer electrode. The ions can be extracted from the system through the diaphragm (12).

FIG. 2 shows the potential characteristics in a cross section of the device according to FIG. 1. At the rod surface (32), the pseudo-potential (33) (shown as dots) decreases on both sides toward the wall surfaces (30, 31) of the tube at approximately $1/r^2$. The curve for the dc voltage potential (34) between the nearest wall (30) of the tube and the rod (32) and the curve for the dc voltage potential (37) between the furthest wall (31) of the tube and the rod (32) are shown as dashed lines. The combination of the pseudo-potential and the dc voltage potential produces an approximately elliptical potential trough (36) and (35) around the rod; the minimum (35) located closest to the center of the tube represents the lowest point of the trough, where the ions collect. In this case, the minimum is shown for the heaviest ions. Since the pseudo-potential depends on the mass, the minimum for the lighter ions is somewhat further from the rod (32).

With multi-rod systems, this type of inside potential gradient in the axia of the system can only be produced by potential penetrations through the gaps between the rods.

FIG. 3 shows an ion-guide system (5) in the form of a hexapole made up of parallel rods with forward propulsion for ions, which collect inside the hexapole system after having been damped in a collision gas. Due to the conical shape of the envelope (16), which carries an ion-repulsion dc potential, a continuously, though not linearly, decreasing potential is produced at the axis of the ion-guide system in the direction of the diaphragm (12). The potential gradient gently propels the ions inside the rod system in the direction of the diaphragm. The potential gradient arises because the distance between the conical envelope (16) and the hexapole (5) increases toward the diaphragm (12). The increasing distance produces a field between the imaginary cylinder of the pole rods and the cone which decreases in field strength toward the diaphragm (12). At the end of the ion-guide system, the ions can be extracted in a known way through the diaphragm (12) with a field penetration from the diaphragm (13) and then formed into a very fine beam (11) of almost monoenergetic ions by using another lens diaphragm (14). With this ion-guide system, it is essential that the ions are injected into the inner space of the rod system and remain there since they can only enter the inner space of the rod system from the outer space if the field strength of the dc voltage is sufficiently high, in other words, at the narrower end of the cone. Those ions in the outer space which are propelled into the other part of the cone by the decreasing dc voltage potential can no longer return to the inside of the rod system and are therefore lost.

FIG. 4 show a similar ion-guide system with ion propulsion where a double helix (2) is used for the rod system instead of a hexapole system.

In a multi-rod system, there are several ways to vary the penetration from the outer dc field into the interior of the rod system along the axis. In general, if the penetration field strength varies along the axis inside the rod system, a potential gradient is formed along the axis which softly propels the ions forward along the axis. This potential gradient along the axis of the ion-guide system can be used to collect ions at certain places or move them along the axis.

Thus, it is possible, for example, to guide the ions, which have been fragmented or cooled in damping gases, gently, but obligatorily, along the axis of the system in a weak but constant potential gradient to the output of the rod system and thus create a very fine beam of almost mono-energetic ions. The creation of an almost mono-energetic beam of small cross section in this context is termed "beam conditioning". A beam conditioned in this way has an extremely small phase space volume. This beam is advantageous since it can be fed into mass spectrometers with only a small phase-space acceptance cross section without any losses. By using this method, the sensitivity and detection limits of the mass spectrometers are increased because the available ions are better utilized. With good ion conditioning, the mass resolution can also be improved in time-of-flight mass spectrometers with orthogonal ion injection etc.

A gradient in the external dc voltage potential along the length of the outer electrode can be produced, for example, by a current-carrying resistance coating on an otherwise insulating tubular electrode or by a tubular electrode (20) made from resistance material, as shown in FIG. 5 where the outer electrode is used to envelope a quadrupole system consisting of a pair of rods (3) and (4). A tube made of insulating material which is wound on the outside, or better still on the inside, with a coil of resistance wire can also be used. It is possible to create separate sections where different potential gradients can be set up by the use of voltage tappings, as shown in FIG. 5 (22), (23), (24) and (25). It is therefore possible, for example, to produce an elongated space for collecting ions between the voltage tappings (23) and (24) located between two sections with potential gradients which propel the ions back. A potential distribution such as this for collecting ions in the center of the ion-guide system is demonstrated by the dashed curve (39) in the lower part of FIG. 5. By switching the voltages at the voltage tappings (22), (23), (24) and (25), this collection space can be actively emptied toward the end of the ion-guide system, in which case, for example, a potential distribution like the dotted curve (38) of FIG. 5 can be set up. At the end of the ion-guide system, a puller lens formed from the diaphragms (12), (13) and (14) can be used to produce an ion beam of the desired shape.

The ions can also collect in the terminal area formed between the voltage tappings (24) and (25), the output of ions being blocked by a switchable puller lens formed from the diaphragms (12), (13) and (14) while the ions are being collected. During the emptying phase, the puller lens is switched to suction and a potential gradient is set up simultaneously in the quadrupole rod system in the direction of the output.

However, the quadrupole system in FIG. 5 can also be used for ion selection, i.e., for selecting the desired parent ions which are to be fragmented to form daughter ions, for example in a downstream ion-guide system or a downstream mass spectrometer. In this case, the selection can take place by resonant ejection in a lateral direction to the rods by superimposing appropriate resonance voltages on the radio-frequency voltage carried by the rods, for example, on two opposite rods or opposite pairs of rods (3) and (4). It is also possible to superimpose opposite dc voltages on the two radio-frequency phases on the rods, a positive dc voltage on one and a negative dc voltage on the other, as in the normal operation of quadrupole filters, so that only the desired ions are retained in a stable manner within the rod system. In order to realize the full effect of the sharp selection of a quadrupole system such as this, the potential of the envelope electrode can be set to zero during the time of selection. Switching the outer potential back on leads to renewed rapid damping of the selected ions which have been excited by the selection process and propelling the selected ions to the exit. Selection can be carried out in a similar manner in higher multipoles, but not quite the same sharpness of selection is achieved.

However, it is also possible to outpulse the ions from such an ion-collection space in a quadrupole, hexapole or octopole system by applying pulse voltages across the rods of the ion-guide system and to propel the ions through a slit in the envelope electrode, in a way similar to the method described for a conventional multipole ion-guide system in Patent Specification U.S. Pat. No. 5,763,878 (Franzen). In this case, the envelope electrode system can be a cylindrical tube with a slit or, better still, a single or multi-component square or rectangular envelope. A square envelope (21) for a system such as this for transverse outpulsing through a slit is shown in FIG. 6. This type of outpulsing can also take place with additional spatial focusing; the ribbon-shaped ion beam is particularly suitable for time-of-flight mass spectrometers. Outpulsing can be facilitated by slitting the envelope tube and applying the appropriate pulses to the individual electrodes. The collected ions can be outpulsed through this slit at an angle transverse to the ion-guide system by switching off the radio-frequency voltage on the quadrupole system and by applying high voltage pulses to the pair of rods (3) and an even higher voltage to the pair of rods (4). The voltage difference first propels the ions inside the quadrupole system itself and the total high voltage propels them through the slit (26) out of the square box (21) in the form of an ion ribbon in the direction (11). The ions can then be analyzed in a time-of-flight mass spectrometer and the voltage difference between the two pairs of rods can be used for space focusing according to Wiley and McLaren (cited above).

It is also possible to set up a potential gradient along the axis of a multipole system consisting of parallel rods (5) by using an outer tube (16) with a conical shape as shown in FIG. 3. The increased distance between the tube (16) and the rod system (5) at one end leads to a reduced field penetration into the rod system, which also reduces the axial potential at this point. Consequently, the ions toward the end of the rod system with the diaphragms (12), (13) and (14) located at the wide end of the cone (16). If the potential gradient at the axis is made sufficiently small and the movement of the ions is decelerated by a damping gas, then the ions will merely be subject to thermal energy scattering. Because of this, the ion beam which is formed (11) will be almost mono-energetic.

With outer tubes (18) which are not simply in the form of a cone as in FIG. 3 but are trumpet shaped as in FIG. 7 (or bell shaped), any potential gradient profile can be produced along the length of the ion-guide system. In this context, a bell-shaped opening is defined as a shape which starts with a more pronounced cone shape then increasingly takes on a more cylindrical form. A conical tube combined with a cylindrical tube can also be used.

Another possibility to generate a potential gradient in the axis of the system consists in using parallel rods having a conical shape in order to vary the field penetration along the ion-guide system. The conical rods have larger gaps between the rods at one end and therefore a different penetration. In this case, the rods have different upper limits for the pseudo-potential which have to be taken into account.

Because they are easy to make, multipole rod systems with rods arranged in a cone (6) inside a cylindrical tube (15) according to FIG. 8, are of particular interest. The rods of the hexapole system (6) are arranged at equal distances from one another on the surface of an imaginary truncated cone. Here too, the penetration of the outer field changes along the length of the ion-guide system because at one end the rods are spread further apart allowing larger openings which, in this case, also allow the outer field, which is increased because of the smaller distance, to penetrate better. The axial potential therefore decreases toward the narrow end of the rod system, and the ions move toward the diaphragm (12) at this narrow end. Depending on the form of the system, the collection and guidance of ions can take place at the axis or in a thread-shaped potential trough along the length of the rods.

The ion-guide system in FIG. 8 is especially suited for fragmenting the ions. Mass-selected ions (10) are injected through the diaphragms (7), (8) and (9) into the wide opening of the ion-guide system where they are fragmented with a collision gas and decelerated to the residual thermal energies. During this process, the ions collect at the axis of the hexapole system arranged in a cone (6) and are slowly guided by the potential gradient in the direction of the ion output (11) where they are extracted through the diaphragm (12) by the potential penetration at the diaphragm (13) and formed into a fine ion beam by the lens diaphragm (14).

It is especially surprising that in the rod system arranged as a cone according to FIG. 8, with an external dc voltage field, oscillating ions are propelled back to the input of the system, i.e. the larger opening of the conical system in the vicinity of the diaphragm (9), while ions which have been successfully damped in the potential trough are propelled to the output (11) through the diaphragm (12). With the appropriate choice of voltages, it is possible to combine the potential troughs at the output at the axis of the system. The reverse propulsion of ions is brought about by the conical arrangement of the rods (6) which, when the particles are reflected, always contribute a component of movement in the direction of the input. It is therefore possible to produce a well-conditioned beam of ions with an extremely small phase space volume. As long as the ions are still oscillating radially, they will be propelled back to the input of the ion-guide system which, however, they are unable to leave because of the dc voltage potential barrier at the diaphragm (9) which is normally used there. They will not be propelled along the axis of the system toward the output through the diaphragm (12) until their radial oscillations have been almost completely damped.

In FIG. 9A (top left) and 9B (top right), potential curves are shown for two cross sections through an ion-guide system with a hexapole rod system: one cross section passing through the rods (42) (9A top left) and another cross section passing through the gaps between the rods (52) (9B top right). The pseudo-potential curve (43, dotted) goes up at the rods (42) and shows a minimum inside the rod system. The dc voltage curve (44, dashed) starts at the potential at the wall (40 and 41), falls in the space outside toward the rods (42) and forms a potential hill inside the rod system with its maximum on the saddle point (46). This saddle point is at the same height as the corresponding saddle point (46) on the curve for the cross section (54) of the dc voltage potential between the rods. This curve for the dc voltage potential (54) of course reaches the same height at the walls (50, 51) as the curve for the other cross section (44). Between the rods (52), the pseudo-potential (53) forms a barrier in each case which, in the absence of an external dc voltage, keeps the ions inside the hexapole system. However, this barrier is not very high and can be easily surmounted by the high-energy ions. But, by superimposing the curve for the dc voltage potential (54), a combined potential curve (55, 56) is produced with a minimum in the center. In this illustration, a dc voltage is selected so that the combined potential characteristic (55, 56) climbs in an only just straight line outward from the rod system. Just outside the rod system, at positions (55), there is a point at which the potential gradient plateaus to zero but there is no secondary minimum. Ions which escape between the rods due to their high energy return to the space inside the rods after their energy has been dissipated by the damping gas.

FIGS. 9C (bottom left) and 9D (bottom right) show the same cross section as that shown in FIG. 9B (top right) but with different dc voltages. If the dc voltage is too small, as shown in FIG. 9C (or if the walls (50) and (51) are further away), then secondary minima (58) are formed outside the rod system where the ions will collect and will not be able to return inside the rod system. The ion-guide systems which were previously shown in FIGS. 3, 4, 7 and 8 each had regions along their length from where the ions could not return because of the secondary minima found there.

At higher voltage, as shown in FIG. 9D, the curve (61, 62) is formed and the secondary minima give way to a potential which increases continuously toward the walls. If their kinetic energy is damped, the ions from the outer space must return inside the rod system. This condition can always be set up in ion-guide systems consisting of parallel rods and an envelope of constant cross section, such as those in FIGS. 5 and 6, by adjusting the voltages.

However, an ion-guide system such as the one shown in FIG. 8 with a conical arrangement of rods in (6) a cylindrical tube (15) also has disadvantages. The ions must be confined within the rod system (6) because otherwise they may be lost. Ions which escape into the space outside the rod system (6) are propelled by the pseudo-potential of the conically arranged rods in the direction of the narrow end of the cone to the diaphragm (12). But here, in the cross-section of the system, the prevailing conditions are those of the combined potentials as shown in FIG. 9C and secondary minima are therefore present outside the rod system (6) which prevent the ions returning to the interior of the rod system (6).

FIG. 10 shows an arrangement for an ion-guide system according to this invention which does not have these disadvantages. This is a hexapole system in a conical arrangement (6) in a conical tube oriented in the same direction but with steeper walls (16). With a suitably chosen ratio between the radio-frequency voltage and the dc voltage, this arrangement is able to force all the ions escaping into the outer space back to the inner space once they have been damped sufficiently by the damping gas.

In spite of the outer cone becoming narrower toward the diaphragm (12) at the output end on the left, the dc voltage potential penetration at the cone (16) into the inner space of the hexapole system (6) is much smaller than at the other end because the distances between the rods (6) decrease more rapidly. There is therefore a potential gradient in the inner space toward the output diaphragm (12). In this case, the potential decrease toward the diaphragm (12) is approximately linear (unlike the embodiment shown in FIG. 8) and the ions drift constantly toward the output. Here, they can be extracted by a voltage at the diaphragm (13) and converted into a fine beam (11).

Ions in the right part of the outer space near to the diaphragm (9) are guided into the inner space of the rod system by the combined potential between the rods (6) because, in this case, the prevailing potential conditions have no external secondary potential minima, which is similar to the situation in FIG. 9D. On the other hand, in the left part of the outer space near to the diaphragm (12), secondary potential minima similar to those in FIG. 9C do form outside the rod system. However, because of the conical shape of the envelope electrode, a potential gradient toward the right part of the outer space prevails in these secondary potential minima. The damped ions in the potential troughs are therefore propelled in the direction of the input of the ion-guide system until they are able to enter the inner space through the gaps between the rods (6). With this ion-guide system, no ions are lost when they escape, for whatever reason, into the outer space.

The arrangement according to FIG. 10 is also especially suitable for fractionation by a collision gas. The ion beam (10) is injected at high energy and the ions are fractionated and decelerated in the collision gas. Even fast and therefore energy-rich ions can be decelerated to thermal energies in a collision cell such as this. Thus, a higher yield of fragment ions can be obtained than would be possible with less deceleration. For this purpose, the ion-guide system must be filled with collision gas at a pressure preferably between approximately 1 and 100 Pascals. The closed envelope (16) makes it easier to introduce the collision gas. In particular, collision gases with a higher molecular weight than nitrogen or helium or a mixture of high and low molecular weight gases can also be used. Although lateral deflection of the injected ions is a frequent occurrence in heavy collision gases such as argon, xenon or krypton, the ions cannot escape from the system provided that their energy is insufficient to reach the wall of the tube (16) or the ion-repellant rods of the rod system (6). As described above, they are always returned from the outer space into the interior of the rod system (6). Their movement is damped to thermal energies and the ions are then transported to the output (11) of the system. This is therefore an optimal embodiment for fragmentation as well as primary ion capture and delivers a continuous stream of ions to the diaphragm (12).

However, the embodiments which have been described can also be used in combination. Of course, it is possible to use conical rods, conical rod systems, conical tubes or potential gradients produced by tubes of current-conducting resistance material in various combinations to obtain a particularly favorable system or systems with favorable switching characteristics.

It is useful but not absolutely necessary to shape the envelope electrodes symmetrically around an axis and orient them symmetrically to the axis of the ion-guide system. The enveloping electrode need not be made out of a single piece of material, different shapes can be used in combination. The envelope electrodes of an ion guide system need not tightly enclose the rod system, it is sufficient if they form an enveloping equipotential surface around the rod system. The conical grid of the envelope electrode system (17) in FIG. 11 is such an example. An electrode system consisting of coaxially arranged rings which carry different dc voltages can also be used as an envelope electrode system. The enveloping does not have to be complete, it is enough for a substantial part of the circumference or length to be enveloped, as shown in FIG. 7 for the trumpet-shaped envelope (18) or the collection toroid (19) in FIG. 12.

An apertured diaphragm connected to a repulsion potential (such as the diaphragm (12) at the output of the various arrangements illustrated) in front of the end of the ion-guide system prevents non-decelerated escape of the ions and thus forms the basis for an ion collection zone in front of the output. With its field penetration reaching through the first apertured diaphragm (12), another parallel apertured diaphragm (13) can extract the ions from the collection space and a further diaphragm (14) can convert them into a very fine ion beam of the desired kinetic energy in order, for example, to inject them into the pulser of an orthogonal, time-of-flight mass spectrometer, a downstream quadrupole filter or an ion trap. The potential of the apertured diaphragm (13) extracting the ions can be switchable so as to correspond to a filling pulse of a pulsed mass spectrometer such as an ion-trap mass spectrometer or an orthogonal, time-of-flight mass spectrometer. With a repulsion potential at the diaphragm (13), the potential gradient in the rod system in front of the diaphragm (12) then increases the collection of ions in front of the diaphragm (12).

In some cases, the envelope electrode of multipole rod systems can even carry an ion attraction potential. The pseudo-potential barriers of the rod system will then be weakened. The ions then no longer collect at the axis of the ion-guide system but in potential troughs nearer to the rods. Ion beams consisting of individual divergent current threads can be generated by suction at the end. Such systems can be used, for example, to facilitate the filling of radio-frequency quadrupole ion traps.

FIG. 12 shows an unusual embodiment with an ion attraction envelope. This embodiment is used for purposes such as collecting ions for pulsed threading into the quadrupole cell of an ion-trap mass spectrometer. The ion-guide system (5) in this case is in the form of a hexapole but it would also be at least as efficient in the form of an octopole system. The ions here are injected from the right by a low-energy ion-focusing system (not shown) into the ion-guide system (5); the ion-guide system is still under a pressure of $10^{-2}$ Pascals nitrogen produced by the differential pump stages. The nitrogen pressure damps the ion movement, although only slightly, so that they can reach the left end of the ion-guide system under their own momentum. Once there, they are met by a slight downward potential gradient due to the potential of the surrounding hollow body (19) which, in this case, is at an ion attraction potential. At the end of the ion-guide system, the ions are reflected at the diaphragm (12), which is at an ion-repulsion potential. The reflection, which is not generally precisely parallel to the axis because of the potential distortion in the diaphragm aperture, in combination with the slight conical construction of the hollow body (19) causes the ions to collect in the space in front of the diaphragm (12). The slight trumpet shape of the hollow body means that the ions are subjected to a constant, slight propulsion in the direction of the diaphragm (12). Initially, their kinetic energy component which is in line with the axis is converted to oscillations lateral to the axis, but these are then slowly decelerated by the damping gas. An ion cloud is formed. The extent of the cloud is determined, on the one hand, by Coulombic repulsion forces and, on the other hand, by the centripetal pseudo-forces of the rod system (5), the repulsion effect of the diaphragm (12) and the driving effect of the penetration potential of the hollow body (19). In this case, the ions do not collect strictly at the axis of the rod system but on a cylinder nearer to the pole rods. Extraction through the diaphragm (12) results in the formation of a slightly funnel-shaped (rather than needle shaped) beam which is favorable for capture in a quadrupole, radio-frequency ion trap.

The ions in this cloud can then be extracted by switching the potential at the diaphragm (13). Applying a strong ion-attraction potential to the diaphragm (13) results in the appearance of a field penetration which reaches through the aperture of the diaphragm (12) into the ion cloud. This field penetration sucks ions out of the cloud and threads them through the apertures of the diaphragms (12), (13) and (14) into the mass spectrometric separator, in this case, an ion-trap mass spectrometer. The apertured diaphragm (14) is used to shape the ion beam further. The apertured diaphragms (12), (13) and (14) therefore form a so-called puller lens which can also be favorably used for other forms of ion-guide systems.

A puller lens is an ion-optical lens which focuses (or defocuses) and accelerates the ions simultaneously. The two sides of the lens are at different potentials. This is in contrast to a so-called Einzel lens (where the potentials on the front and rear are the same) which only focuses (or defocuses) the ions without applying any acceleration. Puller lenses and Einzel lenses are usually made up of concentric, apertured diaphragms. A puller lens system is made up of ion-optical lenses in which at least one puller lens is integrated; a small-area originating location of ions of uniform energy can be transformed into a still smaller image location (ion focus) with a narrow focus or be converted into a parallel beam with a narrow cross section.

A puller lens is able to extract ions from the ion-guide system particularly well if the potential of the second apertured diaphragm (13) penetrates the aperture of the first apertured diaphragm (12) into the ion-guide system. At the first apertured diaphragm (12), the potential is slightly repelling in comparison to the potential at the axis of the ion-guide system. By connecting the potential to the diaphragm (13), it is possible to make the puller lens switchable.

An embodiment of the ion-guide system according to FIG. 5 is also suitable particularly for ion-trap mass spectrometers which only have to be filled with ions approx. every 200 ms. Here, by controlling the potentials at the voltage tappings (22), (23), (24) and (25), it is possible to collect ion clouds first and then drive them through the ion-guide system. As explained above, the ions can also be selected beforehand.

Ion-trap mass spectrometers can be used for purposes such as acquiring granddaughter ion spectra, i.e., for the spectra of fragments of daughter ions, which are themselves obtained as fragment ions of selected parent ions. This procedure can be carried out automatically in ion traps. However, the filling phase, initial selection, initial fragmentation, second selection, second fragmentation and scan take about 400 ms. By carrying out a selection in an initial ion-guide system according to the invention, and then fragmentation followed by selection in a second ion-guide system similar to the one shown in FIG. 5, from which the selected daughter ions are transferred to the ion-trap mass spectrometer, it is possible to reduce the total time to approximately 200 ms. Since approximately five separate spectra must be added to obtain a good sum spectrum, the total time is reduced from two seconds to one second, which represents a considerable improvement in matching to the widths of the chromatography peaks developed beforehand.

The voltages which must be applied to the surrounding body of this invention are determined by the diameter of the ion-guide system, the diameter of the rods (and therefore the gaps between them for the penetration) and the distance between the ion-guide system and surrounding body. However, the voltages are not very high, rather, they can be surprisingly low. For an octopole with a 4 mm internal diameter and a 0.8 mm rod diameter to which approximately 150 volts is applied at a radio-frequency of 2.5 MHz, a voltage of approximately 20 volts is sufficient to produce an ion store such as the one in FIG. 5. With a cone (16) according to FIG. 3, to which a voltage of only 20 volts is applied, a potential difference of up to 2 volts can be set up along the axis. This is sufficient to move the ions gently through the damping gas to the output without adding more kinetic energy due to acceleration.

It has to be taken into consideration that an ion attraction potential creates an upper cut-off limit for the masses of the stored ions, and this can be exploited favorably for some types of mass spectrometer. Ions with masses which are heavier than the upper cut-off limit will leave the ion-guide system because they cannot be retained. (More precisely: the cut-off limit exists for the mass-to-charge ratio, as is usual in mass spectrometry). In any case, the voltages to be considered must be checked experimentally. When referring to "voltages", this is always in reference to the axis potential of the ion-guide system, i.e.,the zero point of the ac voltage at the pole rods.

There is no cut-off limit for ions of large mass in the case of an ion repulsion dc voltage at the surrounding body, but an enclosed rod system has the known cut-off limit for light ions which cannot be eliminated even by an ion-repulsion potential at the envelope electrode. The light ions are gradually lost because they are able to reach the rods of the rod system even though they are not able to reach the outer electrodes.

The structure of the rod system for ion-guide systems can vary considerably. For example, hard-drawn stainless steel wires which have been soft-soldered into round grooves ground into the inside of round ceramic diaphragms have been successfully used. The stainless steel wires can be gold plated, the grooves having been previously metallized by vapour deposition. Round plastic diaphragms with inner grooves and simple adhesive bonding have also been successfully used. Contact wires can be tacked on by spot welding.

One particularly easy method is to attach the rods at the end to electronic printed circuit boards (which can also be used to supply the voltage) mounted on the envelope electrode. On the side facing the rod system, the printed circuit boards can be coated with metal in order to supply the ion-repulsion potential to the ends of the rods. They can therefore take over the function of the diaphragm (12). It is even possible to apply concentric rings with potential stages to the printed circuit boards. The concentric rings can reduce ion losses since they are able to create a gradual transition from the low repulsion potential of the diaphragm (12) near the axis to the higher repulsion potential of the envelope electrode. Multilayered printed circuit boards enable voltages for the rods and attached metallic diaphragms to be supplied within the boards so that the rear side can also be coated with metal. The boards can be adhesively bonded or fastened in some other way directly to the envelope tube and incorporate the supplies for all the potentials for the rods, the envelope electrode and the diaphragms (9) and (12). This type of solidly integrated ion guide system with outer tube and inner rod system also serves to protect the rod system from mechanical damages. Such a system is very rigid and robust.

Ion-guide systems consisting of rings, which have been described at the beginning as a prior art, are not very suitable for the internal rod systems of this invention since the individual supply conductors for the radio-frequency voltages to the rings necessarily disrupt the enveloping potential distributions of the surrounding electrodes. However, it is possible for the outer electrode system to be made up of rings.

Since a gas pressure that is intentionally harmful to ion movements prevails in conditioning ion-guide systems for time-of-flight mass spectrometers, while there has to be a very good vacuum in time-of-flight mass spectrometers, these must be housed in separate vacuum chambers. It is then expedient to integrate the apertured diaphragm of the puller lens system (12), (13) and (14) with the smallest aperture in the wall between the vacuum chambers in a gas tight manner. The aperture diameter of the diaphragm (13) can, for example, be approximately 0.5 mm. In order to maintain a good pressure difference, it helps to form the hole into a small channel. Two apertured diaphragms of the puller lens system can be used to produce a differential pump stage by separate evacuation between the two apertured diaphragms.

Apart from this, for the sake of maintaining a good pressure in the time-of-flight mass spectrometer, it also helps if the pressure of the damping gas in the ion-guide system decreases toward the end. This can be achieved by injecting the gas at the front and setting up a pressure gradient along the length of the ion-guide system by means of holes in the envelope. If solid tubes are used as the outer electrodes, then holes can be made in the tube in the vicinity of the output diaphragm (12).

Time-of-flight mass spectrometers with orthogonal ion injection are usually run at very high cycle speeds, such as 20,000 spectra per second, from which relatively large numbers of individual spectra are usually added very rapidly to sum spectra after digitization. The time-of-flight mass spectrometer can be advantageously used to provide very high levels of mass precision. On the other hand, with 10 to 20 (or even 200 or more) sum spectra per second, it is possible to achieve a high substance resolution when the mass spectrometer is preceded by a rapid separation system. The ion source for these mass spectrometers can therefore be coupled to very fast separation systems for sample separation, such as capillary electrophoresis or microcolumn liquid chromatography systems. It is even possible to link the ion source to tiny electrophoresis separation columns on microfabricated chips. These substance separators then deliver well time-separated substance batches of extremely short time duration from just 10 to 20 ms at high concentration. The ion-guide systems according to this invention maintain these time separations very well in spite of the high level of ion-beam conditioning and do not smear it, as is usually the case for conventional ion-guide systems. Because the flow is continuous, ions which enter the ion-guide system early do not mix with those that enter later, and the time resolution is maintained.

Ion-guide systems according to this invention can be used for very diverse purposes. One interesting application is shown in FIG. 11. In this case, the ions which are introduced to the vacuum of a mass spectrometer via a capillary together with a large quantity of gas are "sieved" from the gas as it leaves and fed in the form of a fine beam (11) to another mass spectrometer for analysis. The ions are sieved out of a jet of gas, which is introduced through a capillary (27) from an ion source at atmospheric pressure. The enveloping conical electrode system, (17) which is maintained at a strong ion-repulsion potential, consists of numerous fine wires which allow excess gas (28) to escape virtually unhindered to a vacuum pump. This enveloping, grid-type electrode system has a similar conical shape to the envelope tube in FIG. 10 in order to force the ions back inside the hexapole rod system. The inner conical hexapole rod system (6) and the outer electrode system (17), which is set at an ion-repulsion potential, thoroughly sieve the ions which enter the ion-guide system with a jet of gas through the capillary (27), damp their movement, collect them at the axis and propel them from the inner space in the direction of the diaphragms (12), (13) and (14). For the sieving-out effect, the jet of gas must not be sharply focused as it passes through the electrode wires (17) otherwise it will carry the ions even against the potential of the electrodes due to the high friction.

Other areas of application include fragmentation steps with simultaneous conditioning, in place of the center quadrupole in triple quadrupole mass spectrometers (triple quads), and fragmentation steps with simultaneous conditioning for time-of-flight mass spectrometers with orthogonal ion injection.

With a knowledge of the basic ideas used in the invention, the specialist is able to combine or adapt or vary the embodiments described in many different ways.

What is claimed is:

1. Ion-guide system, comprising:

an elongated rod system connected to at least one high radio-frequency voltage; and a surrounding envelope electrode system connected to a dc voltage.

2. Ion-guide system according to claim 1 wherein the rod system comprises at least one straight or curved rod connected to at least one phase of a radio-frequency voltage.

3. Ion-guide system according to claim 1 wherein the rod system comprises a single rod.

4. Ion-guide system according to claim 1 wherein the rod system comprises several straight rods.

5. Ion-guide system according to claim 1 wherein the rod system comprises rods that have a conical shape.

6. Ion-guide system according to claim 1 wherein the rod system comprises rods in a conical arrangement.

7. Ion-guide system according to claim 1 wherein the rod system comprises rods in a parallel arrangement that form a quadrupole, hexapole or octopole rod system.

8. Ion-guide system according to claim 7 wherein additional resonance-frequency voltages or dc voltages are periodically superimposed on the radio-frequency voltage connected to the rods in order to remove ions of certain mass-to-charge ratios from the rod system by resonances or instability.

9. Ion-guide system according to claim 7 wherein the dc voltage connected to the envelope electrode can be switched off in predefined time intervals.

10. Ion-guide system according to claim 1 wherein the rod system comprises at least one helical wire.

11. Ion-guide system according to claim 1 wherein the envelope electrode system is symmetrical about an axis.

12. Ion-guide system according to claim 1 wherein the envelope electrode system is a cylindrical, conical, bell-shaped or trumpet-shaped tube.

13. Ion-guide system according to claim 1 wherein the envelope electrode system comprises a resistance material and is connected to at least two voltage supplies so that potential gradients can be set up along the length of the electrode system by applying different voltages to the resistance material from the voltage supplies.

14. Ion-guide system according to claim 1 wherein the ion guide system is filled with collision or damping gas.

15. Ion-guide system according to claim 14 wherein the collision or damping gas is at a pressure between 0.01 and 100 Pascals.

16. Ion-guide system according to claim 1 wherein the envelope electrode system itself does not tightly enclose the rod system but forms an enveloping equipotential surface around the rod system.

17. Ion-guide system according to claim 1 wherein the envelope electrode system comprises several partial electrodes.

18. Ion-guide system according to claim 1 wherein the system is terminated at one or both ends by apertured diaphragms or apertured diaphragm systems to which voltages are connected.

19. Ion-guide system according to claim 18 wherein the apertured diaphragm system at the ion output comprises a puller lens.

20. Ion-guide system according to claim 1 wherein the rods of the rod system are held at the ends by electronic boards from which electric voltages are fed to the rods.

21. Ion-guide system according to claim 20 wherein the electronic boards are part of apertured diaphragm systems located at the ends of the ion guide system.

22. Radio-frequency ion-guide system comprising:

an ion guide; and at least one electrically conductive body that surround the ion guide and to which dc voltages are applied.

23. Radio-frequency ion-guide system according to claim 22 wherein the system comprises parallel rods.

24. Radio-frequency ion-guide system according to claim 22 wherein the system comprises helical wires.

25. Radio-frequency ion-guide system according to claim 22 wherein the surrounding electrically conductive body is symmetrical about an axis and oriented symmetrically in line with the axis of the ion-guide system.

26. Radio-frequency ion-guide system according to claim 22 wherein the electrically conductive body has an interior that is conical or trumpet shaped.

27. Radio-frequency ion-guide system according to claim 22 wherein the ion-guide forms a conical shape and the surrounding electrically conductive body has the form of conical or cylindrical tubes.

28. Radio-frequency ion-guide system according to claim 22 wherein the surrounding electrically conductive body comprises resistance material across which a downward voltage gradient can be generated.

29. Radio-frequency ion-guide system according to claim 22 wherein the system further comprises at least one electrically conductive annular diaphragm to which a voltage can be applied.

30. Radio-frequency ion-guide system according to claim 29 wherein the voltage on the diaphragm can be switched.

31. Radio-frequency ion-guide system according to claim 22 wherein the system comprises a filling apparatus for filling an interior of the system with a collision gas for damping the ion movements or fragmenting the ions.

32. Radio-frequency ion-guide system according to claim 22 wherein the system is closed off at least one end by at least one annular diaphragm to which a voltage may be applied.

* * * * *